US006546581B1

(12) United States Patent
Swietlik et al.

(10) Patent No.: US 6,546,581 B1
(45) Date of Patent: Apr. 15, 2003

(54) CASING SCRAPER

(75) Inventors: George Swietlik, Lowestoft (GB); Matthew Clubb, Barnet (GB)

(73) Assignee: Pilot Drilling Control Limited, Lowestoft (GB)

( * ) Notice: Subject to any disclaimer, the term of this patent is extended or adjusted under 35 U.S.C. 154(b) by 0 days.

(21) Appl. No.: 09/510,935

(22) Filed: Feb. 22, 2000

(30) Foreign Application Priority Data

Mar. 3, 1999 (GB) ..... 9904736

(51) Int. Cl.[7] ..... E21B 37/02; B08B 9/045

(52) U.S. Cl. ..... 15/104.16; 15/104.09; 15/104.2; 166/170; 166/173

(58) Field of Search ..... 15/104.05, 104.09, 15/104.095, 104.16, 104.2; 166/170, 173, 174, 176, 177.3

(56) References Cited

U.S. PATENT DOCUMENTS

| | | | | | |
|---|---|---|---|---|---|
| 2,094,897 | A | * | 10/1937 | Leidecker | 166/176 |
| 2,295,058 | A | * | 9/1942 | Smethers | 15/104.16 X |
| 2,321,275 | A | * | 6/1943 | Blackburn | 166/176 |
| 2,322,419 | A | * | 6/1943 | Cranford | 166/170 |
| 2,397,679 | A | * | 4/1946 | Minyard | 166/173 |
| 2,538,762 | A | * | 1/1951 | Christopher | 166/174 |
| 2,583,044 | A | * | 1/1952 | Earl | 166/176 |
| 2,772,741 | A | * | 12/1956 | Polson | 166/176 |
| 2,836,251 | A | * | 5/1958 | Claypool et al. | 166/173 |
| 2,997,106 | A | * | 8/1961 | Tripplehorn | 166/176 |
| 3,034,581 | A | * | 5/1962 | Reynolds | 166/174 |
| 3,356,143 | A | * | 12/1967 | Polson | 166/176 |
| 3,490,526 | A | * | 1/1970 | Collett | 166/176 |
| 4,085,474 | A | | 4/1978 | Murphy | 15/104.095 |
| 4,189,000 | A | | 2/1980 | Best | 166/173 |
| 4,291,764 | A | | 9/1981 | Pampell | 166/173 |
| 4,479,538 | A | | 10/1984 | Coyle, Sr. | 166/173 |
| 4,572,291 | A | | 2/1986 | Robison | 166/173 |
| 4,811,800 | A | | 3/1989 | Hill et al. | 175/323 |
| 5,570,742 | A | | 11/1996 | Reynolds et al. | 166/173 |

FOREIGN PATENT DOCUMENTS

| | | | | |
|---|---|---|---|---|
| CA | 494541 | * | 7/1953 | 15/104.095 |
| DE | 296188 | * | 1/1917 | 15/104.16 |

OTHER PUBLICATIONS

Specialized Petroleum Services, Ltd. Casing Clean–Up Tool (CCT)™.

Specialized Petroleum Services, Ltd. "Well Patroller"™.

* cited by examiner

*Primary Examiner*—Mark Spisich

(74) *Attorney, Agent, or Firm*—O'Keefe, Egan & Peterman, LLP

(57) ABSTRACT

A casing scraper for cleaning the internal wall of a tube 26 such as a well casing has at least three, rigidly connected, axially and angularly spaced scraper bodies 12, 14, 16 each with a scraping surface 13, 15, 17. The radial dimension of the scraper at each scraping surface is slightly greater than the internal radius of the tube which it will scrape. When the scraper is fully inserted in the tube bore, the scraping surfaces are deflected inwardly and the axial connection 20, 22 between the bodies is accordingly elastically deformed. Th energy stored through this elastic deformation produces a radially outwardly acting force which presses the scraping surfaces 13, 15, 17 against the wall of the tube 26. The eccentric arrangement of the scraping surfaces, and the axial spacing between the surfaces causes the parts of the scraper connecting the scraping surfaces to be placed in bending when the scraper is in place within the tube. The bending of the intermediate parts between the scraping surfaces produces a stress which urges the scraping surfaces into contact with the tube internal surface.

22 Claims, 8 Drawing Sheets

CASING SCRAPER

FIELD OF THE INVENTION

This invention relates to a casing scraper, for cleaning the inner wall surfaces of a tubular member such as a bore casing or lining in an oil or gas well. The invention is not however restricted to this particular application.

BACKGROUND TO THE INVENTION

During the drilling of an oil well, a casing is set into the ground and various drilling and cementing processes take place before the well is ready for production. Prior to production the well casing has to be cleaned to remove debris which may be stuck to the casing walls, resulting from some of the previous well preparation operations.

It is known to pass a casing scraper along the well. Such a scraper has spring-biased brushes or scraping tools which clean the inner surface of the casing as the scraper is moved up and down and rotated in the casing. Examples of such casing scrapers are shown, for example, in U.S. Pat. No. 4,479,538 and in U.S. Pat. No. 5,570,742.

SUMMARY OF THE INVENTION

According to the present invention, there is provided a casing scraper for cleaning the inner surface of a tube of a predetermined internal diameter, the scraper having an axis of rotation, a plurality of axially spaced, rigidly connected scraping surfaces with each surface having an angular extent of less than 180° and being angularly offset from other surfaces, and shank portions rigidly connecting the scraping surfaces to one another, wherein prior to the insertion of the scraper in the tube, first distances, from the axis of rotation to each scraping surface, are greater than the radius of the internal diameter of the tube to be scraped, second distances from the axis of rotation to a surface diametrically opposite to each scraping surface, are less than the tube radius and the sum of the first distance and the second distance at each scraping surface is less than the internal tube diameter such that the shank portions are required to bend to enable the scraper to be admitted to the tube internal diameter.

The eccentric arrangement of the scraping surfaces, and the axial spacing between the surfaces causes the parts of the scraper connecting the scraping surfaces to be placed in bending when the scraper is in place within the tube. The bending or flexing of the intermediate parts between the scraping surfaces produces a stress (stored energy) which urges the scraping surfaces into contact with the tube internal surface. Because the centricity of the scraper is ensured by contact with the tube wall at at least three angularly spaced positions, all the scraping surfaces are positively urged against the tube internal surface, without the need for any relatively moving parts.

The scraping surfaces can be axially spaced by connecting shanks which are integral with the scraping surfaces, or by (modified) drillpipe connecting rods which can be screwed together before the scraper is used.

The scraping surfaces may have surface grooves in the form of a partial helical screw thread which engages with the wall of the tube to perform a scraping action. However other surface formations, or scraping tools such as brushes mounted on the scraper can form the scraping surfaces.

The scraping surfaces, considered together, preferably have an angular extent of 360°. This ensures that all parts of the tube wall are swept, even if the scraper is only moved axially, and not in rotation, as it moves along the tube.

In order to achieve the desired force or side wall loading of the scraping surfaces against the tube wall, the first distance can be 1.005 to 1.010 times the second distance. This relatively small difference between the scraper and the tube internal diameter is sufficient to exert the necessary force to achieve good scraping while allowing the scraper to enter the tube without undue difficulty and without incurring high friction loads between the scraper and the tube walls which could slow down scraping and increase the energy requirement to move the scraper through the tube.

The angular extent of each scraping surface can be between 75 and 125° of arc, and a particularly preferred arc is 120°. Three scraping surfaces can then cover the full 360° circumference.

The scraping surfaces can be connected by connecting rods or drillpipe made to the required length which are screwed together with a scraping body mounted at each screwed junction. The scraper bodies can be eccentric cylindrical bodies with internal splines and the connecting rods can have external splines on which the bodies are mounted against rotation. By assembling the scraper body in this way, it is possible to make up a scraper for various different applications, from component parts. For example, the scraper bodies can be exchanged for different diameter bodies to assemble a scraper for scraping a different diameter tube. A greater or lesser number of scraper bodies can be used depending on the tube diameter, the extent of cleaning likely to be necessary and other factors.

Each screwed junction can include a mounting surface for a scraper body, with part of the mounting surface having an external spline around its circumference and part being smooth around its whole circumference. Each scraper body has a central bore, one end of which can have internal splines and the other end of which can be smooth. This allows the angular orientation of the scraper body to be altered after the connecting rods threads have been engaged but before they have been fully tightened together. The scraper body can be mounted on the junction in any angular orientation and held in that orientation by engagement between the splines.

The splined part of the mounting surface at the junction between two connecting rods can be formed on one of the rods and the smooth part on the other rod.

According to a second aspect of the invention, there is provided a method of cleaning the inner surface of a tube of a predetermined internal diameter using a casing scraper which has an axis of rotation, a plurality of axially spaced, rigidly connected scraping surfaces with each surface having an angular extent of less than 180° and being angularly offset from other surfaces, and shank portions rigidly connecting the scraping surfaces to one another, wherein prior to the insertion of the scraper in the tube, first distances, from the axis of rotation to each scraping surface, are greater than the radius of the internal diameter of the tube to be scraped, second distances from the axis of rotation to a surface diametrically opposite to each scraping surface, are less than the tube radius and the sum of the first distance and the second distance at each scraping surface is less than the internal tube diameter, the method including the step of flexing the shank portions as the scraper is inserted in the tube, so that when the scraper is inserted, the stored energy in the flexed shank portions presses the scraping surfaces against the tube internal wall.

BRIEF DESCRIPTION OF THE DRAWINGS

The invention will now be further described, by way of example, with reference to the accompanying drawings, in which.

DESCRIPTION OF PREFERRED EMBODIMENTS

Figures 1, 4, 5, 6:
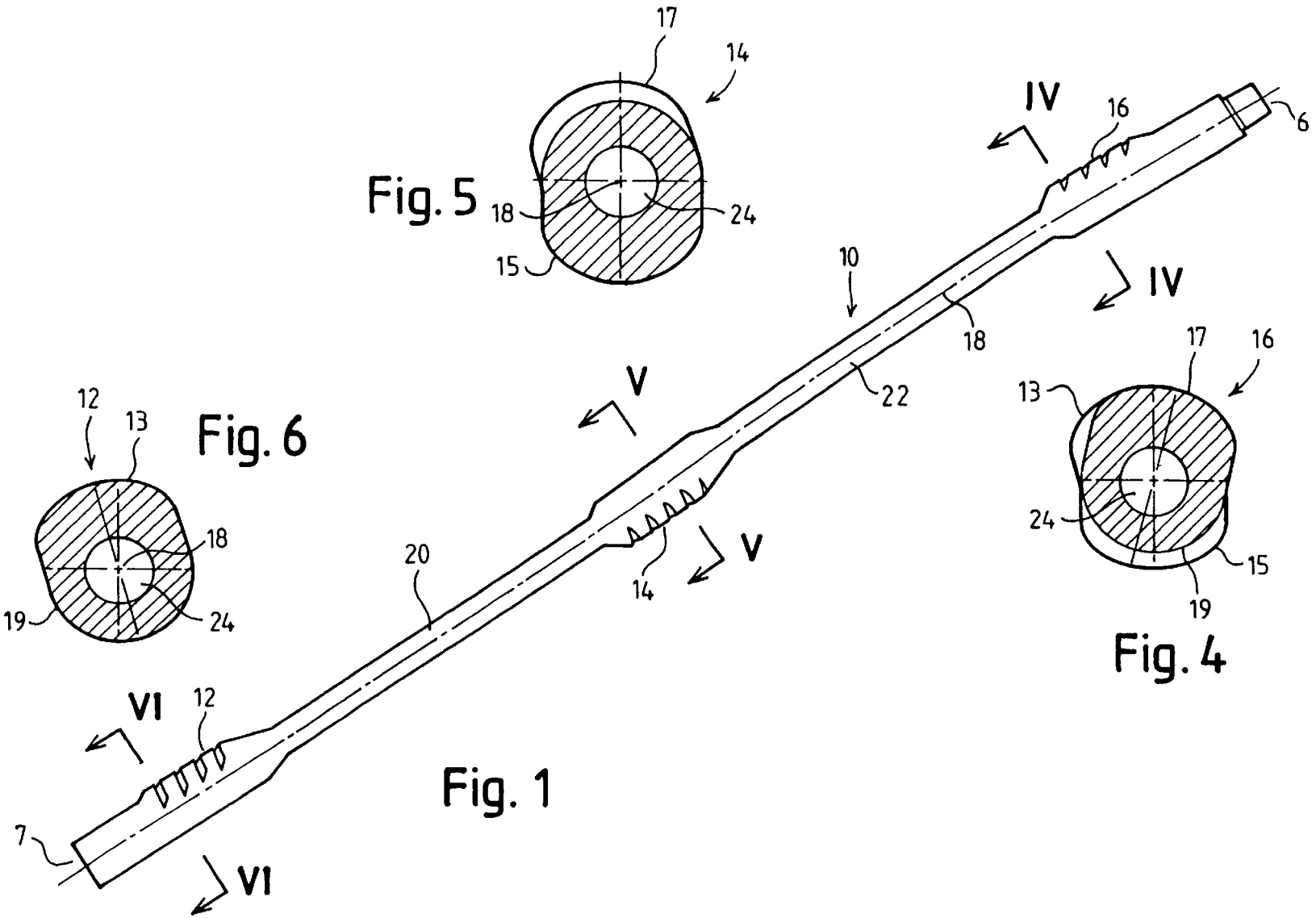
FIG. 1 is a side view of a first embodiment of casing scraper in accordance with the invention.
FIGS. 4, 5 and 6 are, respectively, cross sections through the scraper of FIG. 1 on the lines IV—IV, V—V and VI—VI respectively.

FIG. 1 shows a one piece casing scraper denoted by reference numeral 10. The scraper has an axis 18 and three lobes 12, 14, 16 spaced apart along the length of the scraper axis by connecting shank portions 20, 22. Each of the lobes has a scraping surface 13 as will be described. The scraper has threaded (for example a standard tapered thread often used in drill string applications) or other fittings at its opposite ends 6, 7 by means of which it can be connected into a drill string so that it can be rotated about its axis and pulled and pushed axially along a tube which is to be cleaned. The shank portions 20 and 22 have a smaller cross-sectional area than the lobes 12, 14, 16.

The scraper axis 18 is defined by the geometric centres of the shank sections 20, 22.

Figure 3:
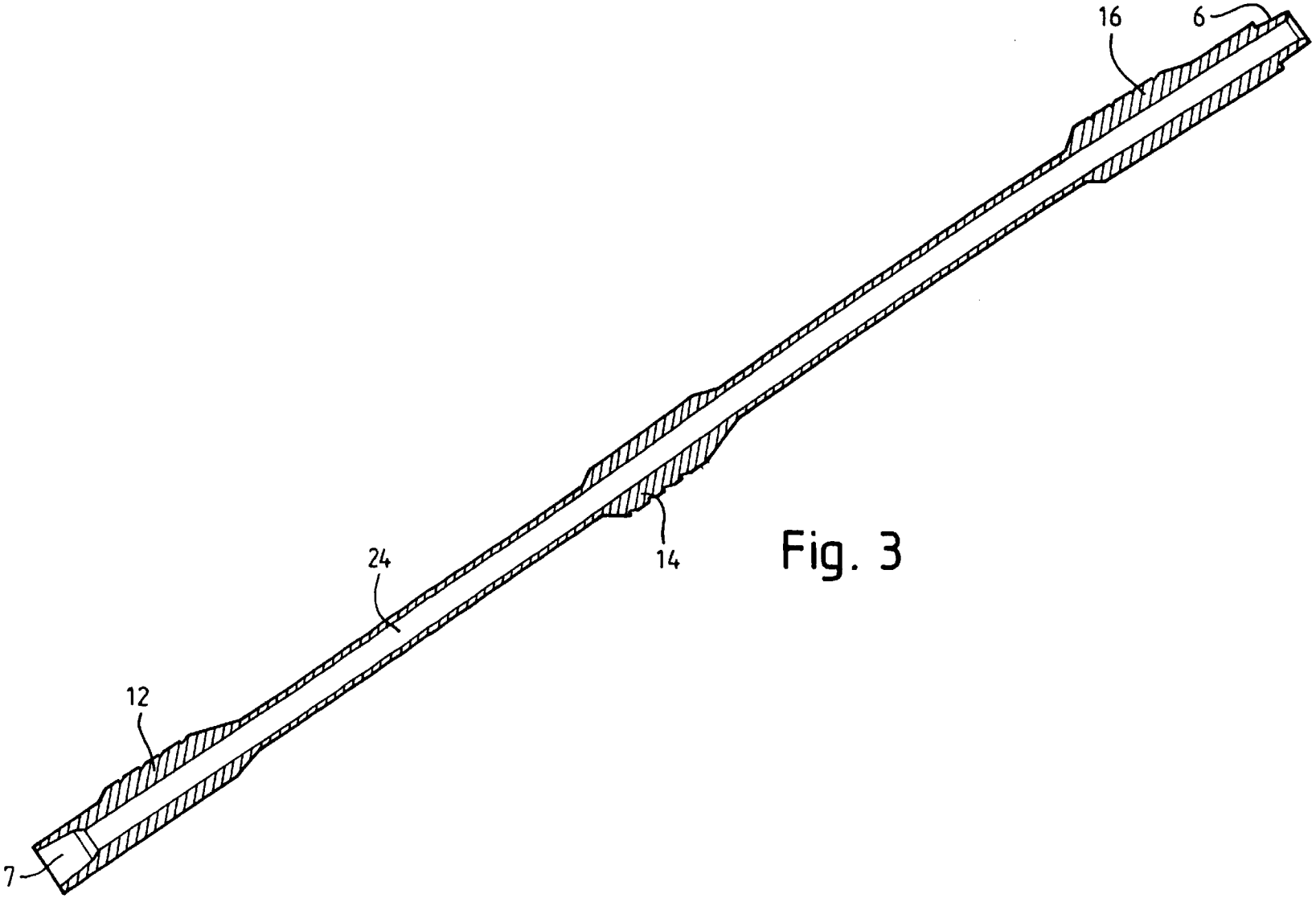
FIG. 3 is a longitudinal cross section through the scraper of FIGS. 1 and 2.

The scraper also has an axial through bore 24, as can be seen in FIG. 3.

The lobes 12, 14, 16 each have an eccentric cross-section with a scraping surface 13, 15, 17 at one part of their circumference and non-scraping surfaces 19. The scraping surfaces are positioned further away from the axis 18 than the remaining pert of the circumference which forms the non-scraping surfaces. This can be seen for example in FIG. 4, where, the radial distance from the axis 18 to the scraping surface 13 is substantially greater than the radial distance from the axis to the non-scraping surface 19.

Figure 10:
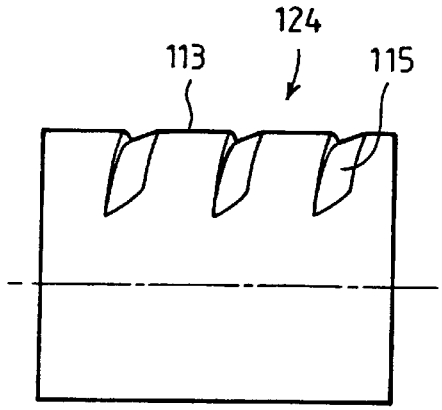
FIG. 10 is a side view of the scraper element of FIG. 9.
Figure 11:
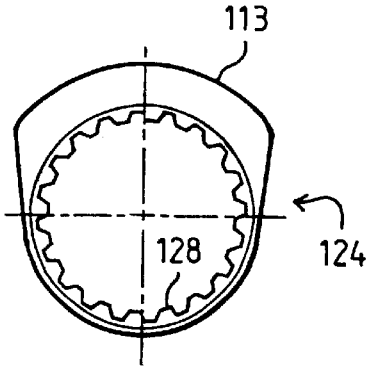
FIG. 11 is an end view of the scraper element of FIGS. 9 and 10.
Figure 12:
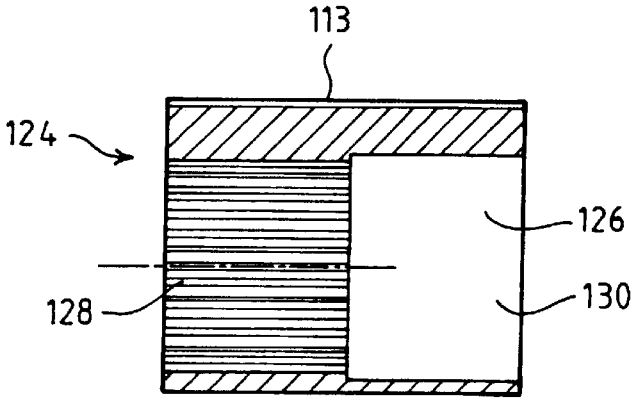
FIG. 12 is a longitudinal cross-section through the scraper element of FIGS. 9–11.

The scraping surfaces have helically extending screw-out grooves 115 (see especially FIG. 10) and when the scraping surface is pressed against the internal diameter of a tube and rotated, the steep flanks of this thread will scrape away any foreign matter adhering to the tube internal diameter. This foreign matter will then be flushed away along the length of the thread.

The invention his not limited to this type of scraping surface. Other formations can be provided to form the scraping surface, and/or brushes or other added features can be used to make contact with the surface to be cleaned. The term 'scraping' is not to be understood as limiting in any way the action of the scraper in cleaning the inner bore of the tube.

Figure 2:
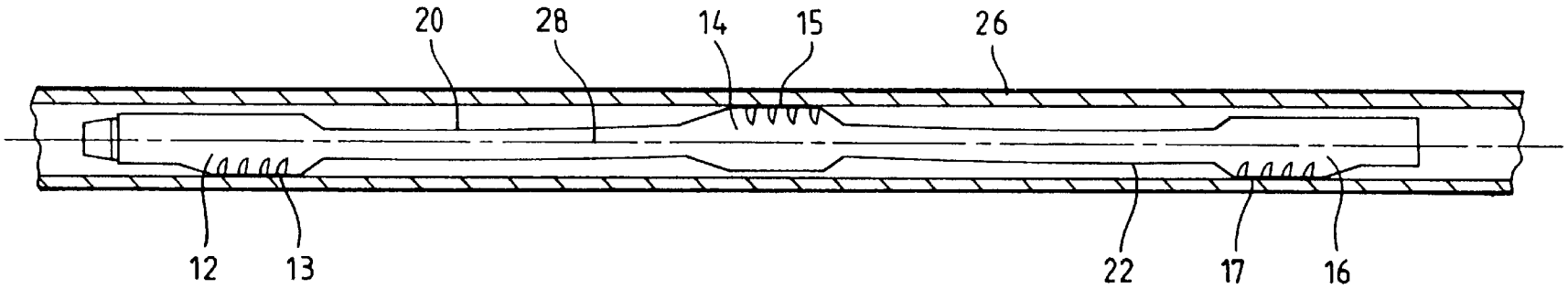
FIG. 2 is a schematic view of a scraper according to FIG. 1 in position in a tube of appropriate size, with the deformation of the scraper shown exaggerated for explanatory purposes.

The dimensions of the lobes 12, 14, 16 on which the scraping surfaces 13 are located are related to the diameter of the tube which is to be scraped in such a way that the scraper has to be distorted to be accommodated within the tube. This is explained with reference to FIG. 2 which shows the distortion exaggerated, for the purposes of explanation. In FIG. 2 the tube being scraped is shown at 26. The centreline of the tube 26 is shown at 28. It will be seen that the shank portions 20 and 22 which link the lobes 12, 14, 16 have to be distorted to allow all the lobes to fit into the tube at the same time, and the elasticity of the shank portions which opposes this distortion will have the effect of urging the scraping surfaces of each lobe against angularly and axially spaced portions of the inner surface of the tube 26. The non-scraping surfaces 19 of the lobes will be out of contact with the inner walls of the tube.

The actual deflection of the shank portions 20, 22 will not be great. The magnitude of the deflection will of course depend on the difference between the internal radius of the tube being cleaned and the distance from the axis 18 to each scraping surface 13. The latter distance will be greater than the former, and it is this difference which will lead to deflection and to the storing of energy in the shank portions 20, 22.

In one example, with an internal diameter of the tube 26 of 8.437 inches, the radial distance from the axis 18 to the surface 13 will be 4.239 inches, and the distance between lobes will be 52 inches. This will give a side load of approximately 750 lbs. at each scraping surface.

Thus, more generally, the radial distance from the axis 18 to the scraping surface 13 will be 1.002 to 1.010 times the internal diameter of the tube to be cleaned, and the side load on the tube internal wall resulting from the different distances should be between 500 and 1000 lbs. to ensure effective cleaning.

The length and cross-sectional dimensions of the shank portions will also have a bearing on the design difference between the internal radius of the tube being cleaned and the distance from the axis 18 to each scraping surface 13. If the shank portions are relatively long or relatively flexible, a greater difference will be appropriate than with relatively stiff or short shank portions.

Figure 7:
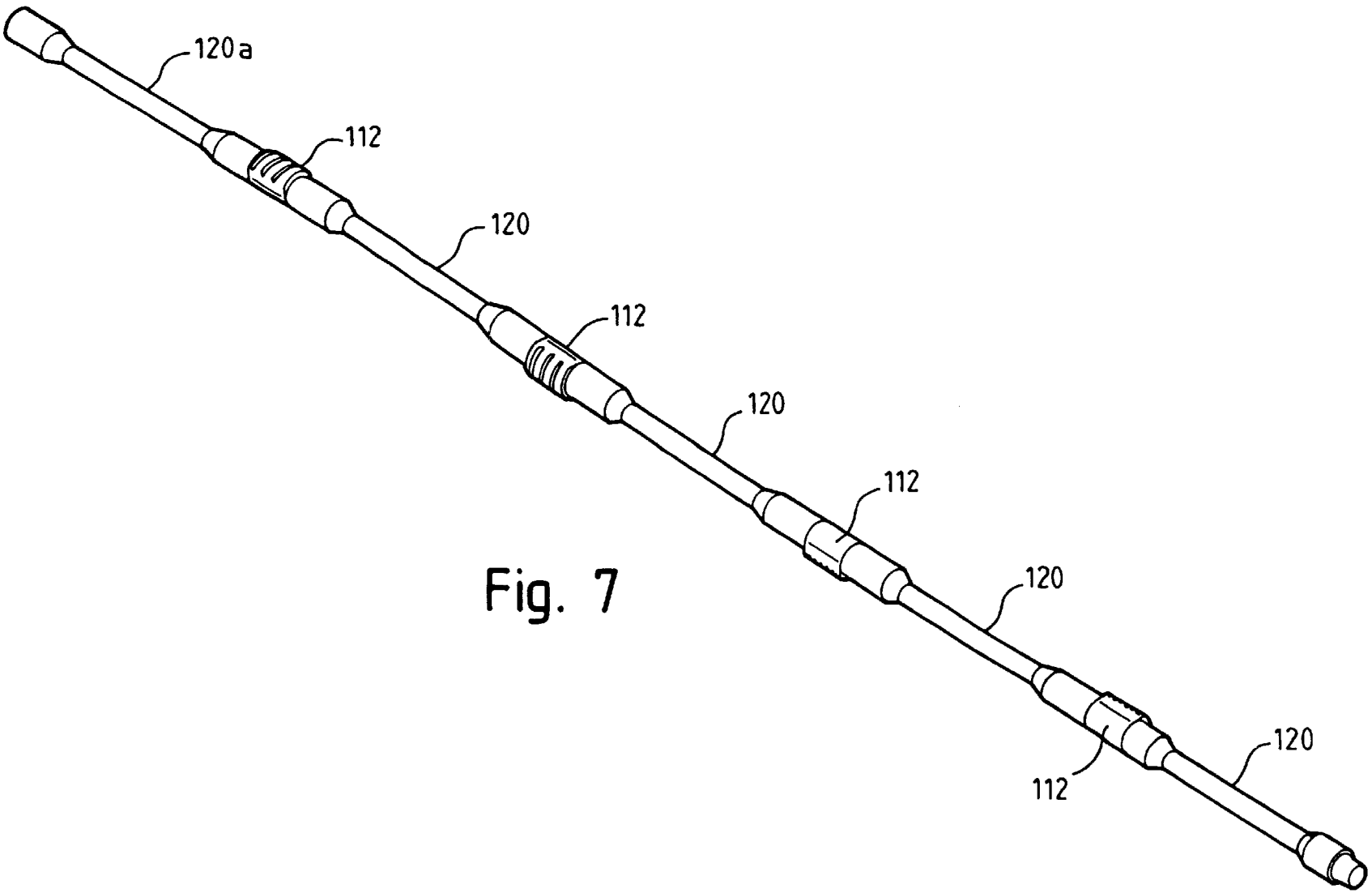
FIG. 7 is a perspective view of an alternative form of casing scraper in accordance with the invention.

FIG. 7 shows a modular form of casing scraper. The embodiment shown in FIG. 7 has four scraping sections 112 connected by shank sections (which may be drillpipes modified to include a splined section) 120. The sections 120 are connected to one another by threaded joints, and the scraping sections 112 are formed by separate scraper bodies 124 held captive on the scraper between two shank sections 120.

There are three different shank sections, 120, 120*a* and 120*b*. Each scraper assembly will have a section 120*a* at one end, section 120 between each pair of scraper bodies 124, and one section 120*b* at the other end.

Figure 8:
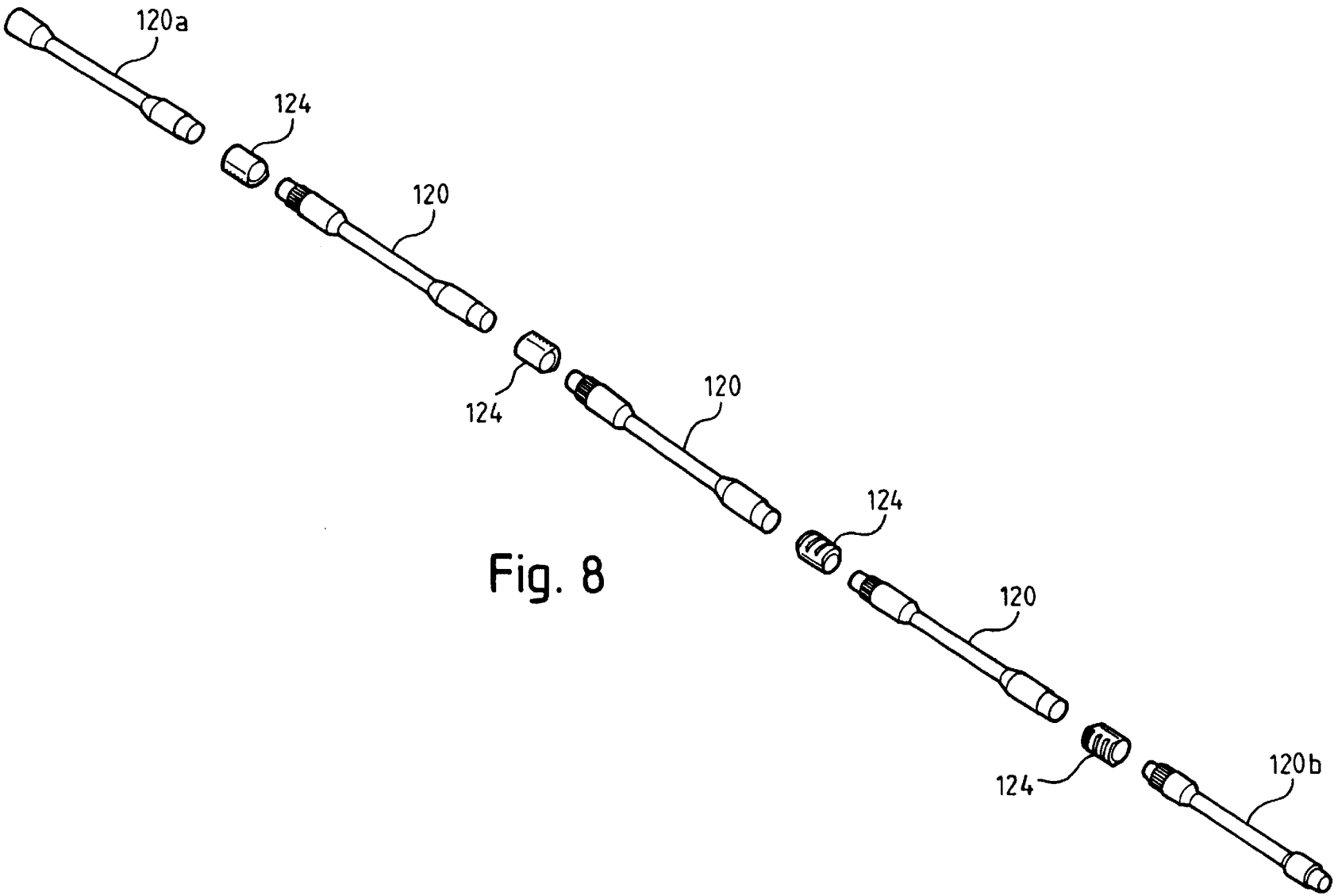
FIG. 8 shows the scraper of FIG. 7 disassembled.

FIG. 8 shows the assembly of FIG. 7 in an exploded state. The individual components are shown in more detail in FIGS. 9 to 14.

Figure 9:
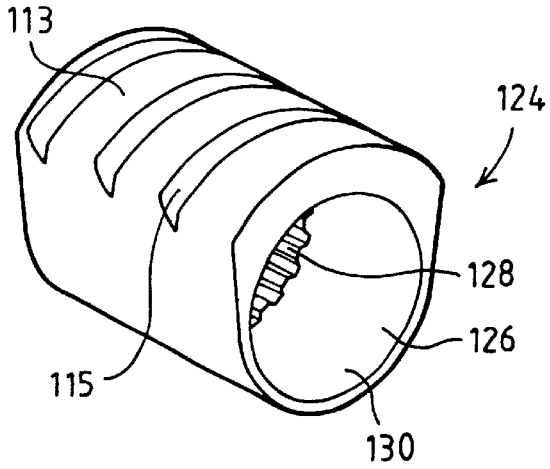
FIG. 9 is a perspective view of a scraper element for use in the embodiment of FIGS. 7 and 8.

FIG. 9 shows a scraper body 124 with a longitudinal bore 126 and a scraping surface 113. The scraping surface has helically extending screw-cut grooves 115 (see especially FIG. 10) and when the scraping surface is pressed against the internal diameter of a tube and rotated, the steep flanks of this thread will scrape away any foreign matter adhering to the tube internal diameter, and this foreign matter will then be flushed away along the length of the thread.

The internal bore 126 is partly splined (at 128) and partly smooth (at 130). This can be seen particularly in FIG. 12.

Figure 17:
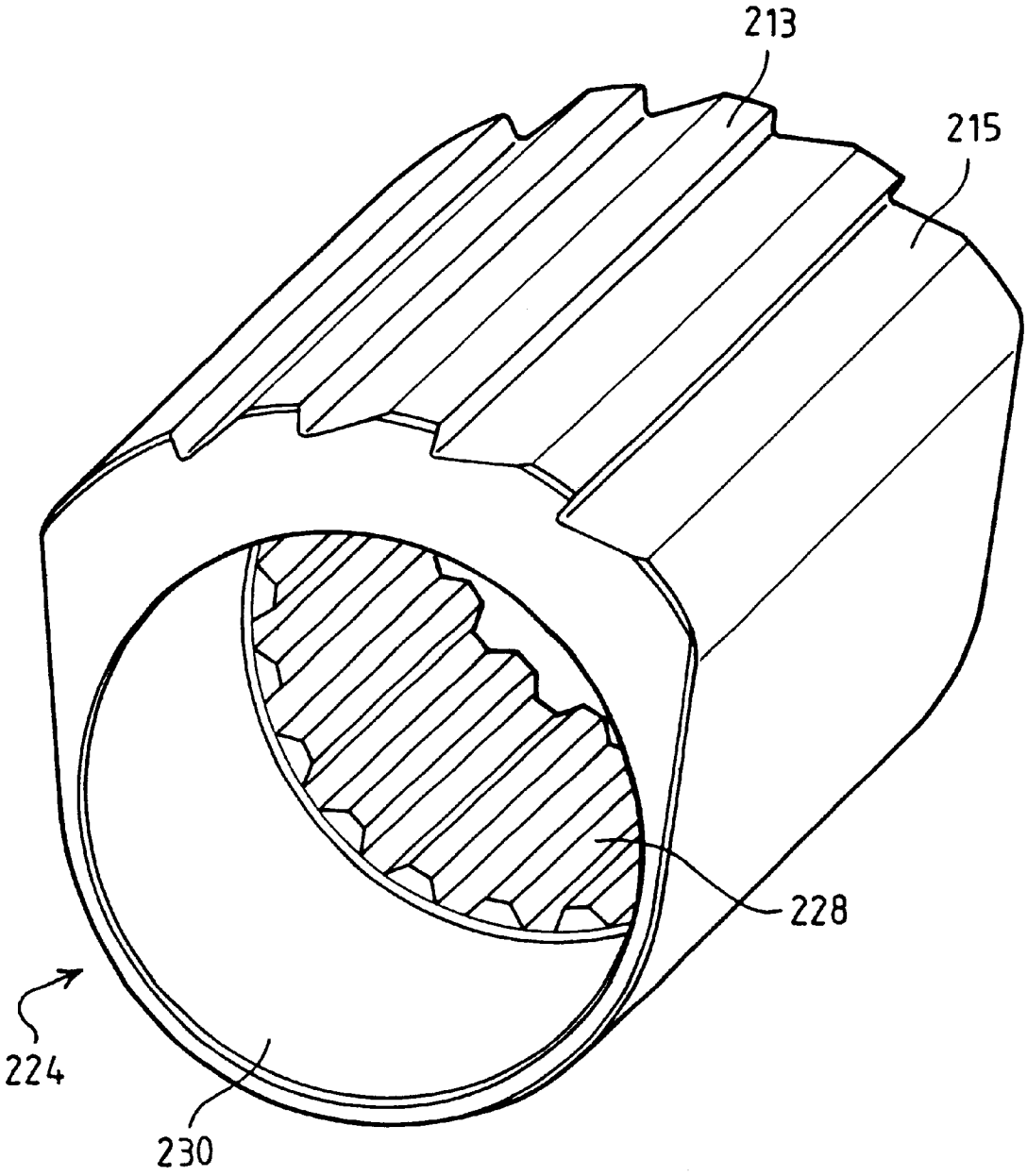
FIG. 17 is a perspective view of an alternative scraper element.

FIG. 17 shows an alternative scraper body 224 with a scraping surface 213 which has substantially axially extending teeth 215. This scraping surface is particularly suitable for use when the tube being scraped is a deviated hole which is not vertical. In this case there is a need to lift the. dislodged debris from the low side of the tube so that it is stirred up and can be flushed away in the flow of flushing fluid passing along the tube.

Figure 13:
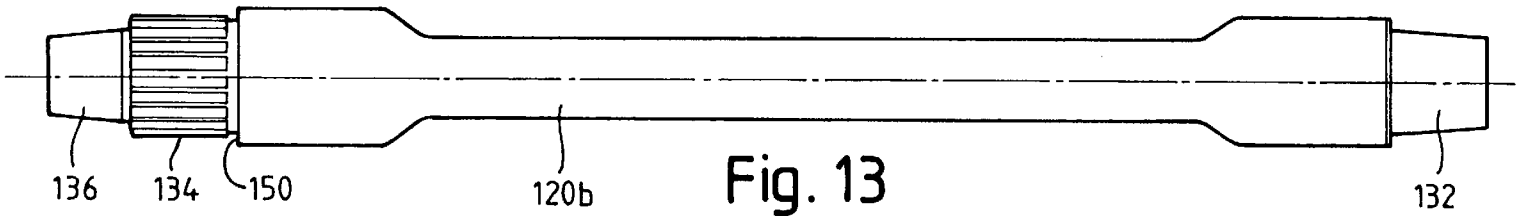
FIG. 13 shows a first connecting rod for use in the scraper of FIGS. 7 and 8.
Figure 14:
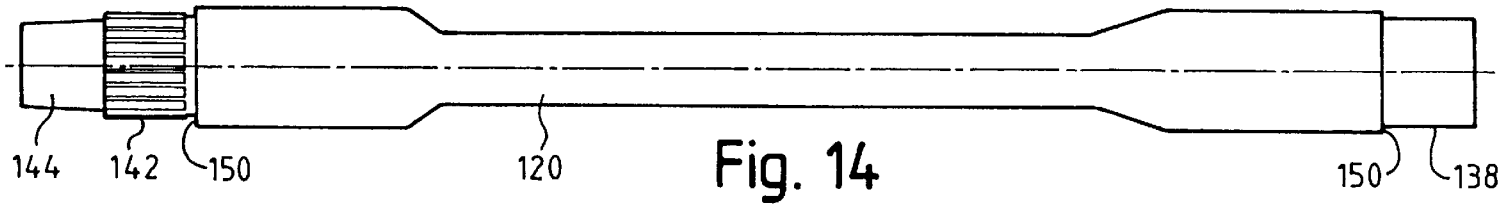
FIG. 14 is a view corresponding to FIG. 13 and showing a second form of connecting rod.
Figure 15:
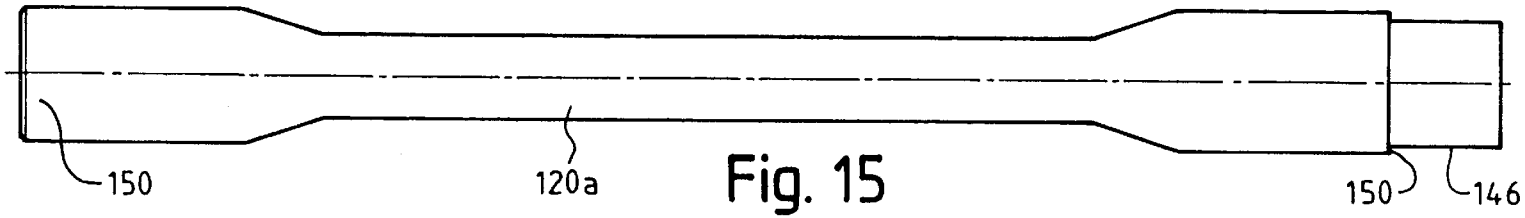
FIG. 15 is a view corresponding to FIG. 13 and showing a third form of connecting rod.

FIGS. 13, 14 and 15 show the connecting shanks 120, 120*a* and 120*b*. The shank 120*b* has a tapered external thread at 132, a parallel splined region at 134 and a second tapered external thread 136.

Figure 16:
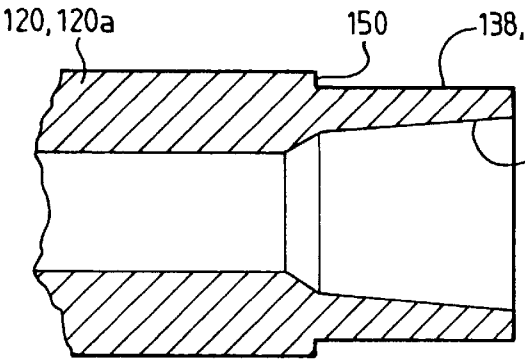
FIG. 16 is a detail, in cross-section, of one end region which is common to the second and third connecting rods of FIGS. 14 and 15.

The shank 120 has a reduced diameter end portion 138 with an internal tapered thread 140 (see FIG. 16), a parallel splined region 142 and a tapered external thread 144.

The shank 120*a* has a reduced diameter end portion 146 with an internal tapered thread 148 (see FIG. 16), and a tapered internal thread in the end 150.

To assemble the scraper, a scraper body 124 is fitted over the splined end portion 134 of the shank 120*b*, and scraper bodies are also fitted over the splined ends 142 of each shank 120. The bodies 124 are set on the splines with the smooth part 130 of their internal bores facing towards the splines, but the length of this smooth part of the bore will be such that there will be a small central region where the splines in the bore 128 engage with the splined regions 134, 142 of the shanks. The thread 136 is then screwed into the thread 140, each thread 144 is screwed into the thread 140 of the next shank 120, and the last thread 144 is screwed into the thread 148 of the shank 120*a*.

Before final tightening of the threads, the bodies 124 will be able to be moved axially sufficiently far to disengage the central splined engagement. The bodies can then be rotated to the correct angular orientation before final tightening when the splined engagement between the bodies and the shanks will reengage.

When the connections have all been made, each body 124 will be supported with part of its length on the splined region 134, 142 and with the other part of its length supported on the reduced diameter region 138, 146. The body will be axially held in position between shoulders 150 on the shanks.

In making these threaded connections, it is very important to ensure that the scraping surfaces 113 of the scraper bodies are correctly angularly offset from one another. The bodies will be angularly locked once the threaded connections are made, through the engagement of the splines 128 on the bodies with the splines 134, 142 on the shanks. Ideally the bodies will be set so that the scraping surfaces of all the bodies taken together will cover a 360° arc.

The scraper described here has, once assembled, no parts which move relative to one another during scraper operation. This is a substantial advantage over scrapers which have separate or integral springs or other resilient mechanisms, as there is nothing which can come loose or separated from the main scraper body during use. The scraper is easy to use and robust.

What is claimed is:

1. A casing scraper for cleaning the inner surface of a tube of a predetermined internal diameter, the scraper comprising:

an axis of rotation, a plurality of axially spaced, rigidly connected scraping surfaces with each surface having an angular extent of less than 180° and being angularly offset from other surfaces, and shank portions rigidly connecting the scraping surfaces to one another, wherein prior to the insertion of the scraper in the tube, first distances, from the axis of rotation to each scraping surface, are greater than the radius of the internal diameter of the tube to be scraped, second distances from the axis of rotation to a surface diametrically opposite to each scraping surface, are less than the tube radius and the sum of the first distance and the second distance at each scraping surface is less than the internal tube diameter such that the shank portions are required to bend to enable the scraper,to be admitted to the tube internal diameter, and wherein the scraping surfaces are connected by connecting rods which are screwed together with a scraping body mounted at each screwed junction.

2. The scraper of claim 1, wherein the scraping bodies are eccentric cylindrical bodies with internal splines and the connecting rods have external splines on which the bodies are mounted against rotation.

3. The scraper of claim 2, wherein each screwed junction includes a mounting surface for a scraping body, part of the mounting surface having an external spline around its circumference and part being smooth around its whole circumference, and each scraping body has a central bore, one end of which has internal splines and the other end of which is smooth, and the scraping body can be mounted on the junction in any angular orientation and held in that orientation by engagement between the splines.

4. The scraper of claim 3, wherein the splined part of the mounting surface at the junction between two connecting rods is formed on one of the rods and the smooth part is formed on the other rod.

5. A combination comprising:

a tube of a predetermined internal diameter; and a casing scraper for cleaning the inner surface of said tube, the scraper comprising:

an axis of rotation, a plurality of axially spaced, rigidly connected scraping surfaces with each surface having an angular extent of less than 180° and being angularly offset from other surfaces, and shank portions rigidly connecting the scraping surfaces to one another, wherein prior to the insertion of the scraper in the tube, first distances, from the axis of rotation to each scraping surface, are greater than the radius of the internal diameter of the tube to be scraped, second distances from the axis of rotation to a surface diametrically opposite to each scraping surface, are less than the tube radius and the sum of the first distance and the second distance at each scraping surface is less than the internal tube diameter such that the shank portions are required to bend to enable the scraper to be admitted to the tube internal diameter.

6. A casing scraper configured for cleaning the inner surface of a tube of a given internal diameter, the scraper comprising:

a plurality of scraping bodies rigidly connected together by a plurality of shank portions between adjacent scraping bodies, the scraping bodies being axially spaced and with the shank portions define an axis of rotation, the shank portions being longer than the scraping bodies;

each of the scraping bodies defining an arcuate scraping surface extending transverse with respect to the axis having an angular extent of less than 180 degrees, the scraping surfaces of each of the scraping bodies being rigidly fixed with respect to the remainder of the scraping body and also angularly offset from the other scraping bodies; and, the scraping surface of each of the scraping bodies being spaced a first distance from the axis of rotation selected to be greater than the radius of the given internal diameter of the tube to be scraped and each scraping body including a surface diametrically opposite the respective scraping surface that is spaced a second distance from the axis of rotation with the first distance being greater than the second distance and the sum of the first and second distances of each respective scraping body is less than the given internal diameter of the tube to be cleaned such that the shank portions are required to bend to enable the scraper to be admitted to the given tube internal diameter.

7. The scraper of claim 6, wherein the scraping surfaces are axially spaced by connecting shanks which are integral with the scraping surfaces.

8. The scraper of claim 6, wherein the scraping surfaces have surface grooves in the form of a partial helical screw thread.

9. The scraper of claim 6, wherein the scraping surfaces, considered together have an angular extent of 360°.

10. The scraper of claim 6, wherein the first distance is 1.005 to 1.010 times the second distance.

11. The scraper of claim 6, wherein the angular extent of each scraping surface is between 75 and 125° of arc.

12. The scraper of claim 6, wherein the scraping surfaces are connected by connecting rods which are screwed together with a scraping body mounted at each screwed junction.

13. The scraper of claim 12, wherein the scraping bodies are eccentric cylindrical bodies with internal splines and the connecting rods have external splines on which the bodies are mounted against rotation.

14. The scraper of claim 13, wherein each screwed junction includes a mounting surface for a scraping body, part of the mounting surface having an external spline around its circumference and part being smooth around its whole circumference, and each scraping body has a central bore, one end of which has internal splines and the other end of which is smooth, and the scraping body can be mounted on the junction in any angular orientation and held in that orientation by engagement between the splines.

15. The scraper of claim 14, wherein the splined part of the mounting surface at the junction between two connecting rods is formed on one of the rods and the smooth part is formed on the other rod.

16. The scraper of claim 6, wherein said scraping bodies comprise eccentric lobes.

17. A casing scraper configured for cleaning the inner surface of a tube of a given internal diameter, the scraper comprising:

an axis of rotation, a plurality of axially spaced, rigidly connected scraping surfaces disposed at predetermined first distances from the axis of rotation, each of said predetermined first distances being selected to be greater than the radius of the given internal diameter of the tube to be scraped, shank portions rigidly connecting the scraping surfaces to one another, and a surface diametrically opposite to each of said plurality of scraping surfaces that is disposed at a predetermined second distance from the axis of rotation, said predetermined second distance being selected to be less than the radius of the given internal diameter of the tube to be scraped so that the sum of the first distance and the second distance at each scraping surface is less than the internal tube diameter such that the shank portions are required to bend to enable the scraper to be admitted to the given tube internal diameter, wherein each scraping surface is configured to have an angular extent of less than 180° and to be angularly offset from other scraping surfaces; and wherein the scraping surfaces have surface grooves in the form of a partial helical screw thread.

18. A casing scraper configured for cleaning the inner surface of a tube of a given internal diameter, the scraper comprising:

an axis of rotation, a plurality of axially spaced, rigidly connected scraping surfaces disposed at predetermined first distances from the axis of rotation, each of said predetermined first distances being selected to be greater than the radius of the given internal diameter of the tube to be scraped, shank portions rigidly connecting the scraping surfaces to one another, and a surface diametrically opposite to each of said plurality of scraping surfaces that is disposed at a predetermined second distance from the axis of rotation, said predetermined second distance being selected to be less than the radius of the given internal diameter of the tube to be scraped so that the sum of the first distance and the second distance at each scraping surface is less than the internal tube diameter such that the shank portions are required to bend to enable the scraper to be admitted to the given tube internal diameter, wherein each scraping surface is configured to have an angular extent of less than 180° and to be angularly offset from other scraping surfaces; and wherein the first distance is 1.005 to 1.010 times the second distance.

19. A casing scraper configured for cleaning the inner surface of a tube of a given internal diameter, the scraper comprising:

an axis of rotation, a plurality of axially spaced, rigidly connected scraping surfaces disposed at predetermined first distances from the axis of rotation, each of said predetermined first distances being selected to be greater than the radius of the given internal diameter of the tube to be scraped, shank portions rigidly connecting the scraping surfaces to one another, and a surface diametrically opposite to each of said plurality of scraping surfaces that is disposed at a predetermined second distance from the axis of rotation, said predetermined second distance being selected to be less than the radius of the given internal diameter of the tube to be scraped so that the sum of the first distance and the second distance at each scraping surface is less than the internal tube diameter such that the shank portions are required to bend to enable the scraper to be admitted to the given tube internal diameter, wherein each scraping surface is configured to have an angular extent of less than 180° and to be angularly offset from other scraping surfaces, and wherein the scraping surfaces are connected by connecting rods which are screwed together with a scraping body mounted at each screwed junction.

20. The scraper of claim 19, wherein the scraping bodies are eccentric cylindrical bodies with internal splines and the connecting rods have external splines on which the bodies are mounted against rotation.

21. The scraper of claim 20, wherein each screwed junction includes a mounting surface for a scraping body, part of the mounting surface having an external spline around its circumference and part being smooth around its whole circumference, and each scraping body has a central bore, one end of which has internal splines and the other end of which is smooth, and the scraping body can be mounted on the junction in any angular orientation and held in that orientation by engagement between the splines.

22. The scraper of claim 21, wherein the splined part of the mounting surface at the junction between two connecting rods is formed on one of the rods and the smooth part is formed on the other rod.

* * * * *